US008360159B2

(12) United States Patent
Williams

(10) Patent No.: US 8,360,159 B2
(45) Date of Patent: Jan. 29, 2013

(54) ROTATING CONTROL DEVICE WITH REPLACEABLE BOWL SLEEVE

(75) Inventors: John R. Williams, Georgetown, TX (US); Theresa J. Williams, legal representative, Georgetown, TX (US)

(73) Assignee: Hampton IP Holding Co. LLC, Georgetown, TX (US)

( * ) Notice: Subject to any disclaimer, the term of this patent is extended or adjusted under 35 U.S.C. 154(b) by 483 days.

(21) Appl. No.: 12/653,234

(22) Filed: Dec. 10, 2009

(65) Prior Publication Data

US 2010/0089655 A1 Apr. 15, 2010

Related U.S. Application Data

(63) Continuation-in-part of application No. 12/069,114, filed on Feb. 7, 2008, now Pat. No. 7,766,100.

(60) Provisional application No. 60/966,280, filed on Aug. 27, 2007.

(51) Int. Cl.
*E21B 19/00* (2006.01)

(52) U.S. Cl. ..... 166/379; 166/85.5

(58) Field of Classification Search ..... 166/379, 166/368, 85.5, 75.13
See application file for complete search history.

(56) References Cited

U.S. PATENT DOCUMENTS

| | | | | |
|---|---|---|---|---|
| 2,995,196 | A * | 8/1961 | Gibson et al. | 175/7 |
| 3,587,734 | A * | 6/1971 | Shaffer | 166/368 |
| 4,448,255 | A * | 5/1984 | Shaffer et al. | 166/387 |
| 4,502,534 | A * | 3/1985 | Roche et al. | 166/84.4 |
| 5,251,869 | A * | 10/1993 | Mason | 251/1.2 |
| 7,997,345 | B2 * | 8/2011 | Hannegan | 166/345 |
| 2002/0121367 | A1 * | 9/2002 | Meek et al. | 166/78.1 |

* cited by examiner

*Primary Examiner* — Daniel P Stephenson
*Assistant Examiner* — Kipp Wallace
(74) *Attorney, Agent, or Firm* — David O. Simmons

(57) ABSTRACT

A rotating control device has a bowl including a central passage configured for having a bearing assembly positioned therein. A bowl sleeve ledge is integral the bowl within the central passage. The bowl sleeve is removably disposed within the central passage. Movement of the bowl sleeve along a length of the central passage is constrained by the bowl sleeve ledge and movement of the bowl sleeve radially with respect to the length of the central passage is constrained by a central passage surface. A sealing device of a first configuration is engaged between an exterior surface of the bowl sleeve and the central passage surface. The bearing assembly has an exterior surface of its outer barrel engaged with the interior surface of the bowl sleeve. A sealing device of a second configuration is engaged between the interior surface of the bowl sleeve and the exterior surface of the outer barrel.

4 Claims, 4 Drawing Sheets

ROTATING CONTROL DEVICE WITH REPLACEABLE BOWL SLEEVE

CROSS REFERENCE TO RELATED APPLICATIONS

This continuation-in-part patent application claims priority from United States Non-Provisional patent application having Ser. No. 12/069,114 filed Feb. 7, 2008 now U.S. Pat. No. 7,766,100 entitled "Tapered Surface Bearing Assembly And Well Drilling Equipment Comprising Same", which Claims priority from United States Provisional Patent Application having Ser. No. 60/966,280 filed Aug. 27, 2007 entitled "Rotating control head, rotating blowout preventor and the like", having a common applicant herewith and being incorporated herein in their entirety by reference.

FIELD OF THE DISCLOSURE

The disclosures made herein relate generally to equipment, systems and apparatuses relating to drilling of wells and, more particularly, to arrangements for seating a bearing assembly within a, bowl of a rotating control device such as, for example, a rotating control head or rotating blowout preventor.

BACKGROUND

Oil, gas, water, geothermal wells and the like are typically drilled with a drill bit connected to a hollow drill string that is inserted into a well casing cemented in a well bore. The drill string includes a plurality of end-to-end connected sections of drill pipe. A drilling head (i.e., a rotating control device) is attached to the well casing, wellhead or to associated blowout preventor equipment, for the purposes of sealing the interior of the well bore from the surface and facilitating forced circulation of drilling substances through the well while drilling or diverting drilling substances away from the well. The drill string passes through the drilling head. Drilling substances include, but are not limited to, water, steam, drilling muds, air, and other flowable substances (i.e., liquids, gases, etc) useful in the drilling operation.

Drilling heads typically include a stationary body, often referred to as a bowl, which carries a bearing assembly. An outer barrel of the bearing assembly is fixedly engaged with the bowl and an inner barrel of the bearing assembly rotates with respect to the outer barrel. The inner barrel of the bearing assembly carries a stripper rubber. The drill string (or other related structure or device) passes through a central bore of the inner barrel and a central aperture of the stripper rubber. A drill bit (i.e., a drill head) is attached to the free end of the last section of drill pipe below the bearing assembly (i.e., the down-hole end of the drill string). In passing through the central aperture of the stripper rubber, the stripper rubber is configured to compressibly and resiliently seals around a outside surface of the drill string, thereby providing a fluid-tight interface between the stripper rubber and the drill string for containing pressurized drilling substances within the well bore, below the bearing assembly. In this manner, the fluid-tight interface between the stripper rubber and the drill string serves to prevent drilling substances within the well bore from escaping from within the well bore between the inner barrel and the drilling string. The stripper rubber is one example of a sealing device that can be carried by a bearing assembly for the purpose of sealing a drillstring or related piece of drilling equipment extending through the bearing assembly.

As modern wells are drilled ever deeper, or into certain geological formations, very high temperatures and pressures may be imparted upon the drilling substances within the well bore. These rigorous drilling conditions pose significant danger to rig personnel. Examples of such dangers include, but are not limited to being subjected to scalding, burning or contamination by drilling substances such as steam, hot liquids, caustic fluids, and the like. Accordingly, the stripper rubber is replaced periodically to maintain suitable sealing performance at the interface between the sealing device and the drill string.

For similar reasons to why it is imperative to maintain adequate seal between the stripper rubber and the drill string, it is also imperative that a suitable seal be maintained between the bowl and the outer barrel. To this end, a plurality of O-ring seals (i.e., sealing devices) is typically carried on the exterior surface of the outer barrel such that a fluid-tight interface is provided between mating surfaces of the outer barrel and the bowl. These O-ring seals prevent drilling substances from escaping from within the well bore between the mating surfaces of the outer barrel and the bowl. To this end, the O-ring seals can be replaced periodically to maintain suitable sealing performance at the interface between the mating surfaces of the outer barrel and the bowl.

The surface of the bowl that engages the mating surface of the outer barrel can become damaged, thereby preventing the O-ring seals from suitable providing a fluid-tight interface between the mating surfaces of the outer barrel and the bowl. For example, when installing a drill bit into the well bore, the bearing assembly is not yet in place and, thus, the bowl is exposed to contact with the drill bit. As such, contact of the drill bit with the outer barrel engaging surface of the bowl can result in damage to the outer barrel engaging surface of the bowl. If such damage compromises the fluid-tight seal provided by the O-rings of the outer barrel, the damage must be rectified prior to commencing drilling operations. Accordingly, a drawback of prior art bowls with outer barrel engaging surface of the bowl machined directly into the bowl is that the entire bowl typically must be removed from the drilling rig or associated piece of well drilling equipment in order to repair the damaged portion of the outer barrel engaging surface or to replace the bowl. Such removal of the bowl is time consuming, thereby making it an expensive and undesirable undertaking.

SUMMARY OF THE DISCLOSURE

Embodiments of the present invention overcome drawbacks of prior art rotating control heads, rotating blowout preventors and/or the like (i.e., rotating control devices). Rotating control devices in accordance with the present invention have a bowl sleeve that is removably mounted within the bowl. Advantageously, in rotating control devices configured in accordance with the present invention, the bearing assembly is seated on a mating surface of the bowl sleeve as opposed to a surface integrally formed in the bowl (e.g., a sidewall structure thereof). As is well known in the art, in a conventional bowl, the surface of the bowl that engages the mating surface of the bearing assembly can become damaged, thereby preventing a fluid-tight interface being provided between the mating surfaces of the bearing assembly and the bowl. Bowls configured in accordance of the present invention allow the bowl sleeve to be readily removed and replaced without requiring the bowl to be removed from the drilling rig or associated piece of well drilling equipment. This ability to remove and replace the bowl sleeve without requiring the bowl to be removed from the drilling rig or associated piece of well drilling equipment is beneficial in that such removal of the bowl is time consuming, thereby making it an expensive and undesirable undertaking.

In one embodiment of the present invention, a bowl assembly for a well drilling head, comprises a bowl, a bowl sleeve, and one or more sealing devices. The bowl has a sidewall structure defining a central passage configured for having a bearing assembly positioned therein. The sidewall structure has a bowl sleeve engaging structure integral therewith within the central passage at a position between an upper end portion of the sidewall structure and a lower end portion of the sidewall structure. The bowl sleeve is removably disposed within the central passage. Movement of the bowl sleeve along a length of the central passage is constrained by the bowl sleeve engaging structure and movement of the bowl sleeve radially with respect to the length of the central passage is constrained by an interior surface of the sidewall structure. An interior surface of the bowl sleeve is configured for being engaged by a mating exterior surface of an outer barrel of the bearing assembly. The one or more sealing devices are engaged between the exterior surface of the bowl sleeve and the interior surface of the sidewall structure.

In another embodiment of the present invention, a rotating control device configured for use in drilling wells comprises a bowl, a bowl sleeve, a bearing assembly, and a plurality of different sealing devices. The bowl has a central passage configured for having a bearing assembly positioned therein and has a bowl sleeve ledge integral therewith within the central passage at a position between an upper end portion of the bowl and a lower end portion of the bowl. The bowl sleeve is removably disposed within the central passage. Movement of the bowl sleeve along a length of the central passage is constrained by the bowl sleeve ledge and movement of the bowl sleeve radially with respect to the length of the central passage is constrained by a central passage surface of the bowl. An interior surface of the bowl sleeve is configured for being engaged by a mating exterior surface of the outer barrel of a bearing assembly. One or more sealing devices of a first configuration are engaged between the exterior surface of the bowl sleeve and the central passage surface. The bearing assembly has an exterior surface of an outer barrel thereof engaged with the interior surface of the bowl sleeve. One or more sealing devices of a second configuration are engaged between the interior surface of the bowl sleeve and the exterior surface of the outer barrel.

In another embodiment of the present invention, a method for providing a replaceable bowl sleeve within a bowl of a rotating control device comprises a plurality of operations. An operation is performed for providing a bowl having a bearing assembly engagement surface machined in a surface thereof within a central passage thereof. After providing the bowl, an operation is performed for enlarging a portion of the central passage to have a minimum inside diameter of a specified dimension. The enlarged portion of the central passage extends from an upper end face of the bowl to at least a position between the upper end face thereof and the bearing assembly engagement surface. An operation is then preformed for providing the well drilling head bowl with a bowl sleeve ledge within the central passage at a position within or terminating by the enlarged portion of the central passage, followed by an operation for removably disposing a bowl sleeve within the enlarged portion of the central passage. Movement of the bowl sleeve along a length of the central passage is constrained by the bowl sleeve ledge and movement of the bowl sleeve radially with respect to the length of the central passage is constrained by a central passage surface of the bowl. In conjunction with removably disposing the bowl sleeve within the enlarged portion of the central passage, an operation is performed for providing at least one sealing device between the exterior surface of the bowl sleeve and the central passage surface of the bowl.

These and other objects, embodiments, advantages and/or distinctions of the present invention will become readily apparent upon further review of the following specification, associated drawings and appended claims. Furthermore, it should be understood that the inventive aspects of the present invention can be applied to rotating control heads, rotating blowout preventors and the like. Thus, in relation to describing configuration and implementation of specific aspects of the present invention, the terms rotating control head and rotating blowout preventors can be used interchangeable as both are oil well drilling equipment that provides functionality that will benefit from the present invention.

DETAILED DESCRIPTION OF THE DRAWING FIGURES

Figure 1:
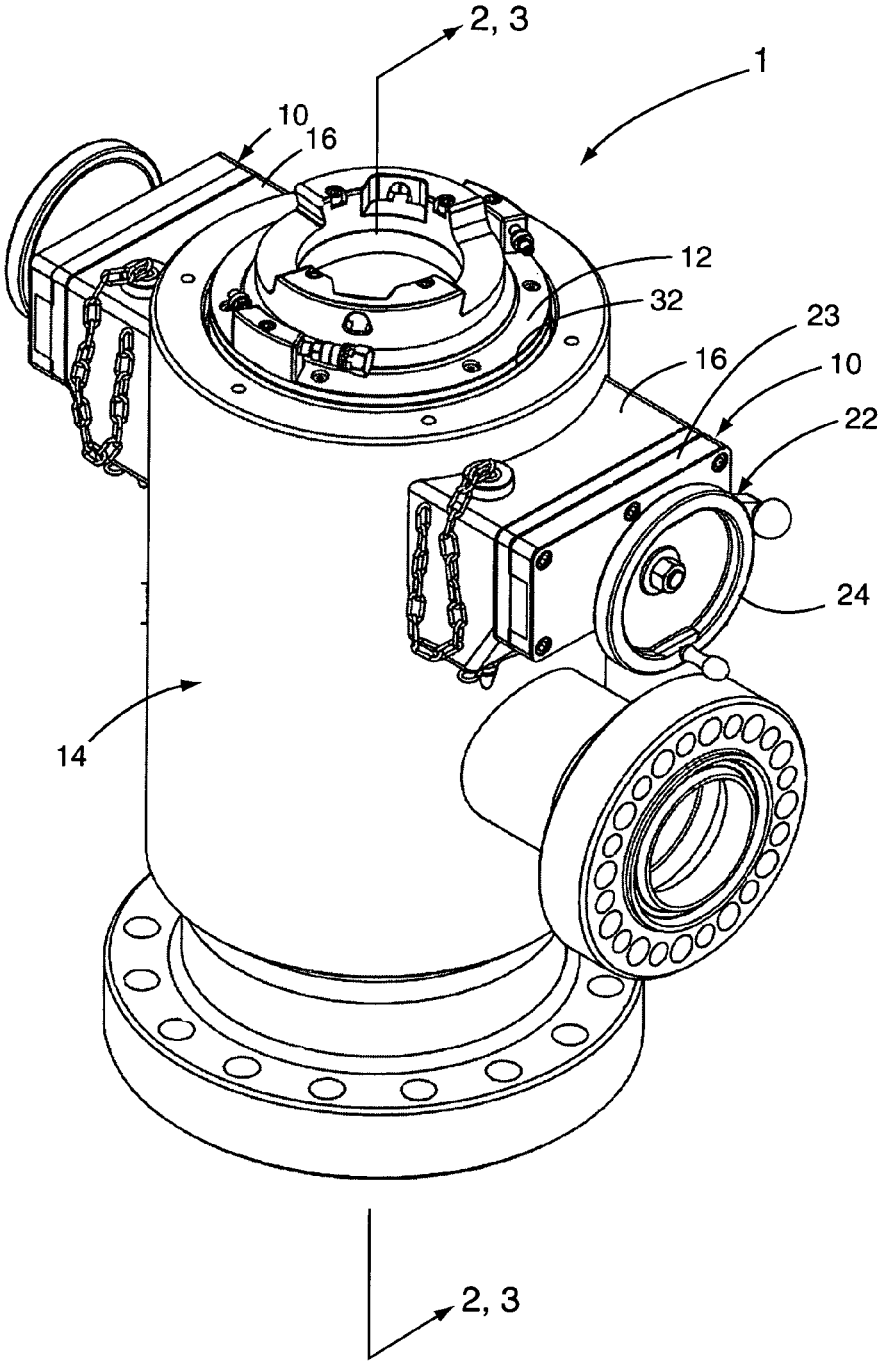
FIG. 1 is a perspective view of a rotating control device in accordance with an embodiment of the present invention, wherein the rotating control device includes a ram-style bearing assembly retaining apparatus.
Figure 2:
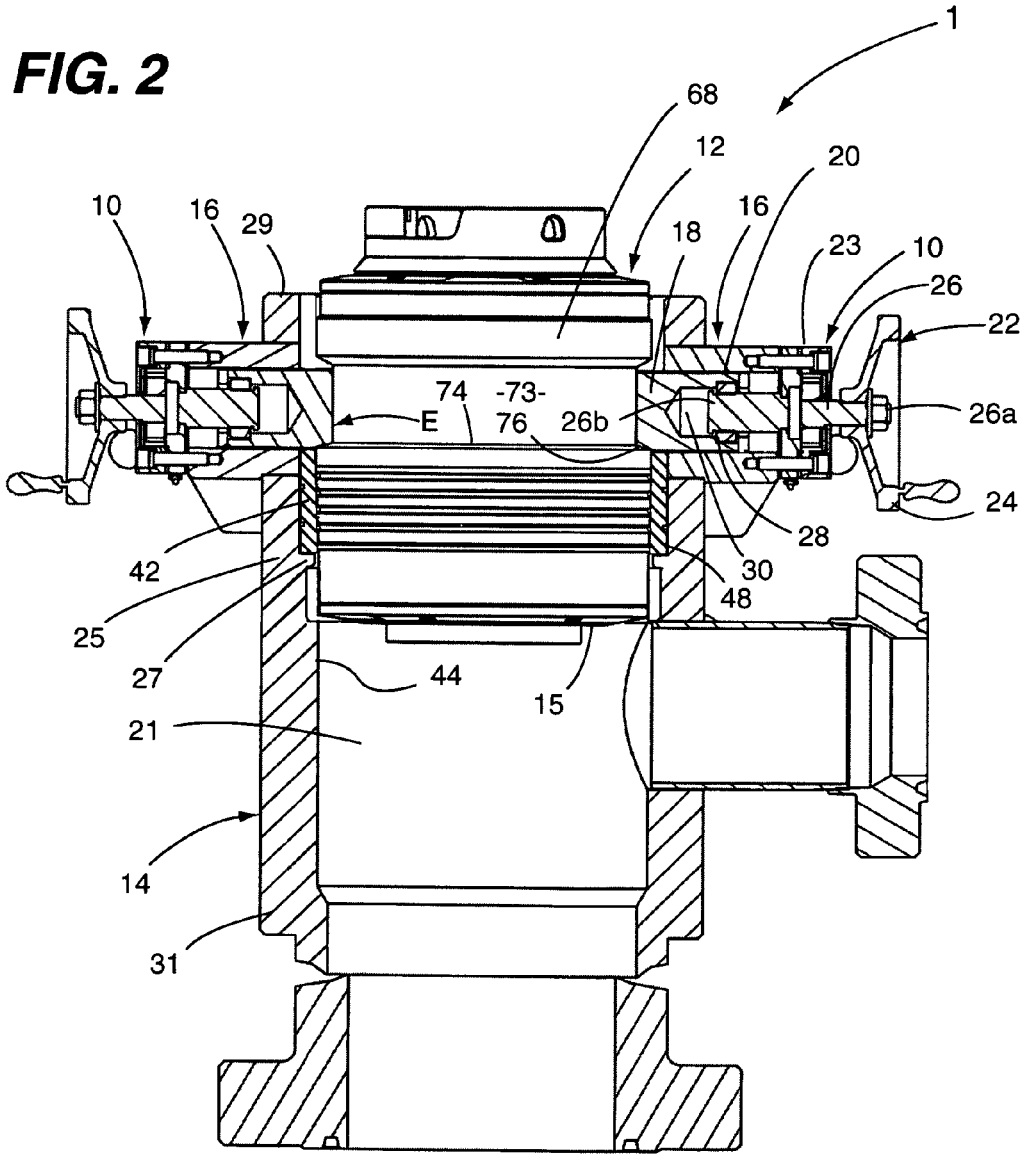
FIG. 2 is a cross-sectional view taken along the line 2-2 in FIG. 1, showing the ram-style bearing assembly retaining apparatus engaged with a bearing assembly of the rotating control device.
Figure 3:
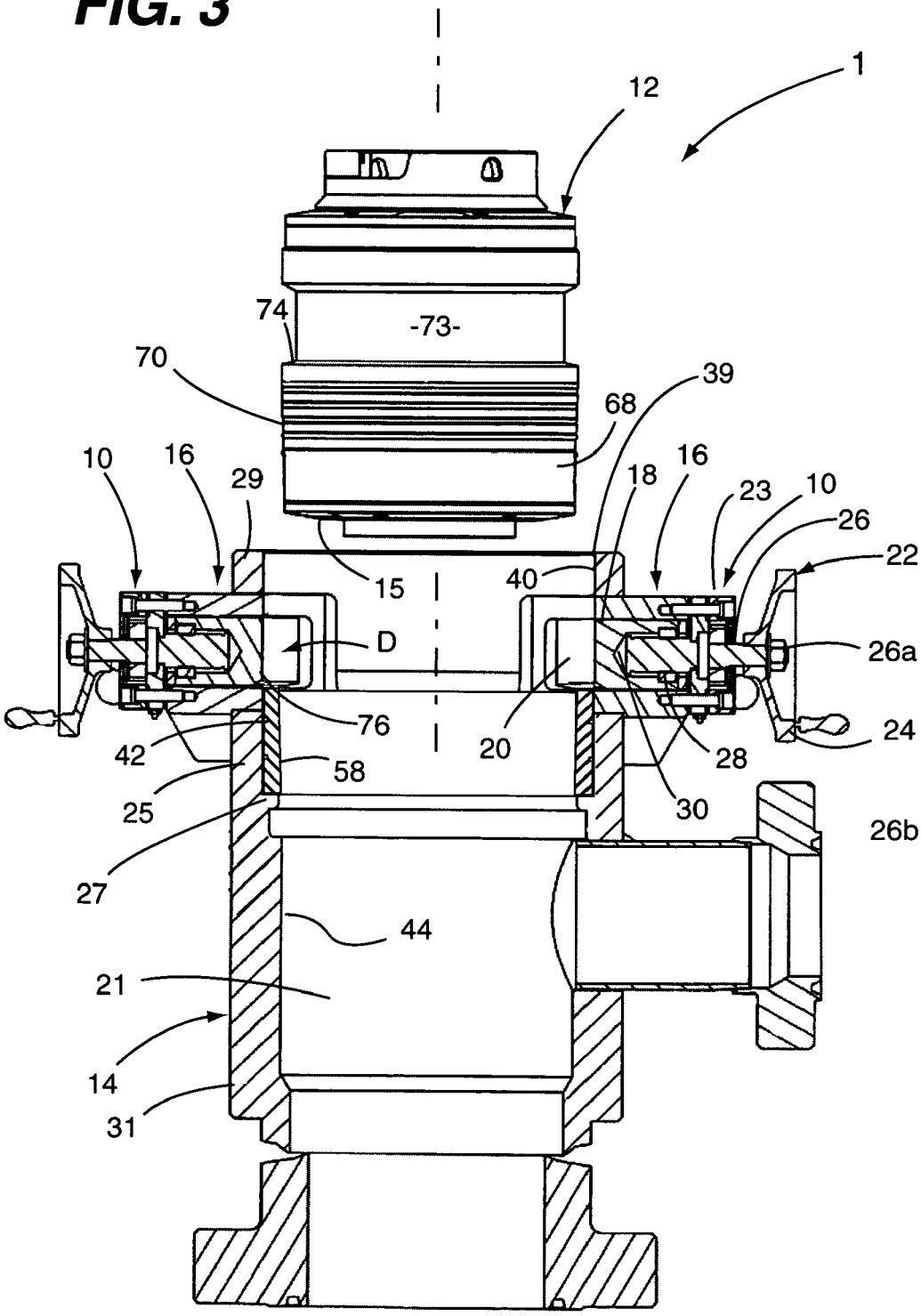
FIG. 3 is a cross-sectional view taken along the line 3-3 in FIG. 1, showing the ram-style bearing assembly retaining apparatus disengaged and the bearing assembly in a removed position with respect to a bowl of the rotating control device.

FIGS. 1-3 show various aspects of a rotating control device 1 in accordance with an embodiment of the present invention. The rotating control device 1 is commonly referred to as a low pressure rotating control head. It is disclosed herein that embodiments of the present invention can be readily implemented in high-pressure rotating control devices. As illustrated in FIGS. 1-3, it can be seen that the rotating control device 1 utilizes a ram-style retaining apparatus that includes a plurality of angularly spaced apart ram assemblies 10 to retain a bearing assembly 12 in a fixed position with respect to a bowl 14 (i.e., an equipment housing). An inner barrel 15 of the bearing assembly 12 is configured for having a stripper rubber assembly attached to a lower end portion thereof.

Each ram assembly 10 is fixedly mounted on a respective receiver 16 of the bowl 14 and, as shown in FIGS. 2 and 3, includes a ram 18 slideably disposed within a bore 20 of the respective receiver 16. Each ram assembly 10 includes a selective displacement means 22 coupled between a mounting plate 23 of the ram assembly 10 and the ram 18. The mounting plate 23 is fixedly attached to the respective receiver 16. Operation of the selective displacement means 22 allows a position of the ram 18 within the bore 20 to be selectively varied. In this manner, the selective displacement means 22 allows the ram 18 to be selectively moved between an engagement position E (FIG. 2) and a disengagement position D (FIG. 3).

As illustrated, each selective displacement means 22 includes a hand-operated crank 24, drive axle 26 and interlock member 28. The drive axle 26 is rotatable mounted on the respective mounting plate 23 in a manner that effectively precludes longitudinal displacement of the drive axle 26 with respect to the mounting plate 23. The hand-operated crank 24 is fixedly attached to a first end 26*a* of the drive axle 26 such that rotation of the crank 24 causes rotation of the drive axle 26. A second end 26*b* of the drive axle 26 is in threaded engagement with the interlock member 28. The interlock member 28 is retained within a central bore 30 of the ram 18 in a manner that limits, if not precludes, its rotation and translation with respect to the ram 18. Accordingly, rotation of the drive axle 26 causes a corresponding translation of the ram 18, thereby allowing selective translation of the ram 18 between the engagement position E and a disengagement position D.

As shown, the two ram assemblies 10 are angularly spaced by approximately 180-degrees are provided for retain the bearing assembly 12 in the fixed position with respect to the bowl 14. However, a ram-style retaining apparatus in accordance with the present invention is not limited to two ram assemblies. It is disclosed herein that a ram-style retaining apparatus can include more than two ram assemblies or, conceivably, only one ram assembly can be implemented. It is further disclosed herein that the ram-style retaining apparatus can be replaced with a clamp style retaining apparatus such as that taught by Williams in U.S. Pat. No. 5,662,181. Embodiments of the present invention are not unnecessarily limited to a particular type of apparatus for retaining a bearing assembly in fixed relationship with respect to a bowl.

Figure 4:
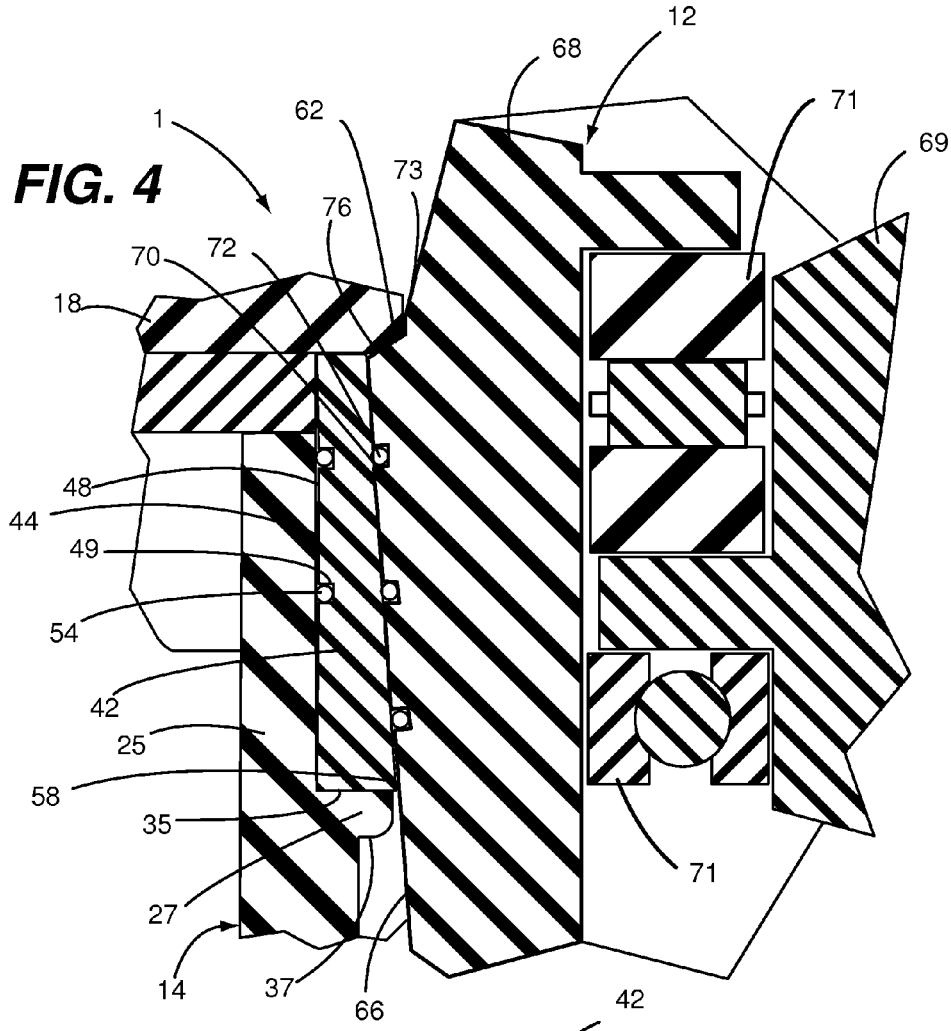
FIG. 4 is fragmentary cross-sectional view showing relationship and configuration of the bowl sleeve, bowl, bearing assembly and ram shown in FIGS. 2 and 3.
Figure 5:
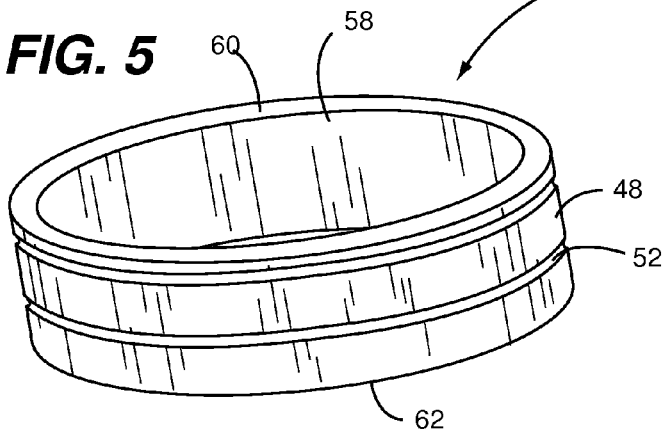
FIG. 5 is a perspective view of the bowl sleeve shown in FIGS. 2-4.

Referring to FIGS. 2-4, the bowl 14 includes a central passage 21 that is configured for having the bearing assembly 12 positioned therein. A sidewall structure 25 of the bowl 14 defines the central passage 21. The sidewall structure 25 has a bowl sleeve engaging structure 27 integral therewith within the central passage 21 at a position between an upper end portion 29 of the sidewall structure 25 and a lower end portion 31 of the sidewall structure 25. As shown, the bowl sleeve engaging structure 27 includes a ledge 35 and a shoulder 37 integral with the sidewall structure 25. The bowl sleeve engaging structure 27 can define a transition at which a diameter of the central bore 32 changes from a first diameter to a second diameter substantially less than the first diameter. In a preferred embodiment, the central passage 21 has a substantially constant diameter from a first end face 39 of the sidewall structure to approximately the bowl sleeve engaging structure 27.

A bowl sleeve 42, which is also referred to herein as a replaceable wear sleeve, is removably disposed within the central passage 21. The bowl sleeve engaging structure 27 constrains movement of the bowl sleeve 42 along a length of the central passage 21 in a direction toward the lower end portion 31 of the sidewall structure 25. An interior surface 44 (i.e., inside face) of the sidewall structure 25 constrains movement of the bowl sleeve 42 radially with respect to the length of the central passage 21. The sidewall structure 25 and the bowl sleeve 42 can be jointly configured whereby an interference fit or a clearance fit is provided between the bowl sleeve 42 and the sidewall structure 25. It is also disclosed herein that sidewall structure 25 and the bowl sleeve 42 can be jointly configured whereby the bowl sleeve 42 is threadedly engaged with the sidewall structure 25.

A plurality of sealing devices. 46 are engaged between an exterior surface 48 of the bowl sleeve 42 and the interior surface 44 of the sidewall structure 25. Preferably, but not necessarily, the bowl sleeve 42 has a substantially constant outside diameter at its exterior surface 48. In a preferred embodiment, as best shown in FIG. 4, circumferential grooves 49 are provided in the exterior surface 48 of the bowl sleeve 42 and an O-ring seal 54 is disposed within each one of the circumferential grooves 49 of the bowl sleeve 42. Optionally, one or more circumferential grooves can be provided in the interior surface 44 of the sidewall structure 25 and an O-ring seal can be disposed within one or more of the circumferential grooves of the bowl sleeve 42 the interior surface 44 of the sidewall structure 25. It is also disclosed herein that one or more circumferential grooves can be provided in the face of the ledge 35 or bottom end face 56 of the bowl sleeve 42 and an O-ring seal can be disposed therein. The present invention is not unnecessarily limited by a particular means by which a fluid-tight seal is provided between the sidewall structure 25 and the bowl sleeve 42.

An interior surface 58 of the bowl sleeve 42 is tapered from a top end face 60 thereof to a bottom end face 62 thereof. Similarly, an exterior surface 66 of an outer barrel 68 of the bearing assembly 12 is respectively tapered (e.g., a 2-degree taper) for providing a tapered interface between the outer barrel 68 and the bowl sleeve 42 when the bearing assembly 12 is seated in the central passage 21. In this manner, the interior surface 58 of the bowl sleeve 42 is configured for being engaged by the exterior surface 66 (i.e., a mating exterior surface) of the outer barrel 68. A plurality of circumferential seal-receiving grooves 70 are provided in the exterior surface 66 of the outer barrel 68. A sealing device 72 (e.g., O-ring seals) is provided in one or more of the seal-receiving grooves 70 for providing a fluid-tight seal between the outer barrel 68 and the bowl sleeve 42. The bearing assembly 12 includes an inner barrel 69 positioned within a central passage of the outer barrel 68 and a plurality of bearing units 71 coupled between the inner barrel 69 and outer barrel 68 for providing concentric alignment of the barrels 68, 69 and allowing rotation therebetween. As such, a skilled person will appreciate that the tapered inside face of a central bore of an equipment housing (e.g., a bowl) can be carried by a replaceable wear sleeve (i.e., also referred to herein as a bowl sleeve). The replaceable wear sleeve can be removed and replaced as needed for addressing wear and routine maintenance.

The outer barrel 68 includes a circumferential recess 73 that defines an angled ram engagement face 74. Each ram 18 includes an angled barrel engagement face 76. In this manner, engagement of the angled ram engagement face 74 of the outer barrel 68 by the angled barrel engagement face 76 of the rams 18 urges the bearing assembly 12 toward the second end portion 31 of the bowl 14.

In operation, the bearing assembly 12 is lowered into the central passage 21 of the bowl 14 with the rams 18 in their respective disengaged position D. Through rotation of the respective crank 24 in a first rotational direction, each ram 18 is moved from its disengaged position D to its engaged position E. In its engaged position E, the angled barrel engagement face 76 of each ram 18 is engaged with the angled ram engagement face 74 of the outer barrel 68. Through such engagement of the angled barrel engagement face 76 of each ram 18 with the angled ram engagement face 74 of the outer barrel 68, the exterior surface 66 of the outer barrel 68 is biased against the interior surface 58 of the bowl sleeve 42. Rotation of the cranks 24 in a second rotational direction causes the rams 18 to move from their respective engaged position E to their respective disengaged position D, thereby allows the bearing assembly 12 to be removed from within the central passage 21.

Various aspects of the ram-style retaining apparatus illustrated in FIGS. 1-4 can be altered without departing from the underlying intent and functionality of a ram-style retaining apparatus in accordance with the present invention. One example of such alteration is for the hand-operated crank 24 can be replaced with an electric, pneumatic or hydraulic motor arrangement for allowing motor-driven rotation of the drive axle 26. Another example of such alteration is for the hand-operated crank 24 to be replaced with a non-manual device. One example of such alteration is for the hand-operated crank 24, drive axle 26 and interlock member 28 to be replaced with a linear motion arrangement such as a hydraulic or pneumatic ram apparatus. Still another example of such alteration is for a discrete locking arrangement to be provided for securing a respective ram 18 in its engaged position to limit the potential for unintentional movement of the ram 18 toward its disengaged position. Yet another example of such alteration is for the angled ram engagement face 36 and the angled barrel engagement face 76 to be replaced with non-tapered faces (e.g., curved faces) that provide the same biasing functionality when such faces are brought into engagement with each other. And still a further example of such alteration in the, optional inclusion of a means such as, for example, a pilot actuated valve circuit that prevents movement of the rams 18 from the engaged position toward the disengaged position (e.g., by preventing release and/or application of pressure to a ram cylinder or pump).

It is disclosed herein that a bowl that was originally manufactured with a bowl engaging surface integral with a sidewall structure thereof can be modified for receiving a bowl sleeve configured in accordance with the present invention. For example, it may be beneficial to modify the bowl disclosed that by Williams in U.S. Pat. No. 5,662,181 to include a replaceable bowl shelve configured in accordance with the present invention. Similarly, in manufacturing any rotating control device, it would be beneficial to provide it with a replaceable bowl shelve configured in accordance with the present invention A method for providing a replaceable bowl sleeve within a bowl of a rotating control device begins with performing an operation for providing a bowl having a bearing assembly engagement surface machined in a surface thereof within a central passage thereof. In one embodiment of the present invention, the bowl can includes other ancillary components (e.g., ram receivers) that are be mounted on the bowl in a manner whereby such ancillary components extend into or through a sidewall structure of the bowl. After providing the bowl, an operation is performed for enlarging a portion of the central passage to have a minimum inside diameter of a specified dimension. The enlarged portion of the central passage extends from an upper end face of the bowl to at least a position between the upper end face thereof and the bearing assembly engagement surface. In one embodiment, enlarging the central passage includes using a machining process to remove material from a sidewall structure defining the central passage and using a machining process to remove material from ancillary components of the bowl that extend at least partially though the sidewall structure. Furthermore, such enlarging can include providing the central passage with a substantially constant inside diameter from an upper end face of the bowl to a position at or beyond the bearing assembly engagement surface. Next, an operation is preformed for providing the well drilling head bowl with a bowl sleeve ledge within the central passage at a position within or terminating by the enlarged portion of the central passage, followed by an operation for removably disposing a bowl sleeve within the enlarged portion of the central passage. In one embodiment, providing the well drilling head bowl with a bowl sleeve ledge is performed in combination with enlarging the portion of the central passage to have the minimum inside diameter. Movement of the bowl sleeve along a length of the central passage is constrained by the bowl sleeve ledge and movement of the bowl sleeve radially with respect to the length of the central passage is constrained by a central passage surface of the bowl. In conjunction with removably disposing the bowl sleeve within the enlarged portion of the central passage, an operation is performed for providing one or more sealing devices between the exterior surface of the bowl sleeve and the central passage surface of the bowl. In one embodiment, providing such one or more sealing devices between the exterior surface of the bowl sleeve and the central passage surface of the bowl includes providing an O-ring seal in a circumferential groove within the bowl sidewall structure and/or the exterior surface of the bowl sleeve.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A rotating control device configured for use in drilling wells, comprising:

a bowl having a central passage and having a bowl sleeve ledge integral therewith within the central passage at a position between an upper end portion of the bowl and a lower end portion of the bowl;

a bowl sleeve removably disposed within the central passage, wherein movement of the bowl sleeve along a length of the central passage is constrained by the bowl sleeve ledge, wherein movement of the bowl sleeve radially with respect to the length of the central passage is constrained by a central passage surface of the bowl, wherein an entire portion of the bowl sleeve is located at a position within the central passage of the bowl, and wherein an interior surface of the bowl sleeve is tapered from a top end face thereof to a bottom end face thereof;

at least one sealing device engaged between the exterior surface of the bowl sleeve and the central passage surface;

a bearing assembly positioned within the central passage of the bowl and having an exterior surface of an outer barrel thereof directly engaged with the interior surface of the bowl sleeve, wherein the exterior surface of the outer barrel is tapered to mate with the tapered interior surface of the bowl sleeve; and at least one sealing device engaged between the interior surface of the bowl sleeve and the exterior surface of the outer barrel;

wherein mating surfaces of the central passage of the bowl and the bowl sleeve are jointly configured for providing an interference fit between the bowl sleeve and the central passage of the bowl thereby causing the bowl sleeve to remain engaged with the bowl until the bowl sleeve is removed for addressing wear and routine maintenance thereof and thereby allowing the bearing assembly to be disengaged from the bowl sleeve while the bowl sleeve remains engaged with the bowl.

2. The rotating control device of claim 1 wherein:

the central passage has a substantially constant diameter from a first end face of the bowl to approximately the bowl sleeve ledge; and the bowl sleeve has a substantially constant outside diameter at its exterior surface.

3. The rotating control device of claim 2 wherein:

the bowl sleeve ledge defines a transition at which a diameter of the central bore changes from a first diameter to a second diameter substantially less than the first diameter;

the central passage has a substantially constant diameter from a first end face of the sidewall structure to approximately the bowl sleeve ledge;

the bowl sleeve has a substantially constant outside diameter at its exterior surface;

the bowl sleeve includes a circumferential groove in the exterior surface thereof; and said at least one sealing device includes an O-ring seal disposed within the circumferential groove.

4. The rotating control device of claim 3 wherein:

the bowl sleeve includes a circumferential groove in the exterior surface thereof; and said at least one sealing device engaged between the exterior surface of the bowl sleeve and the central passage surface includes an O-ring seal disposed within the circumferential groove.

* * * * *